US006179101B1

(12) United States Patent
Lin

(10) Patent No.: US 6,179,101 B1
(45) Date of Patent: Jan. 30, 2001

(54) FOLDABLE SUITCASE HAVING FOLDABLE HANDLE DEVICE

(76) Inventor: Chao Chin Lin, P.O. Box 63-99, Taichung (TW), 406

( * ) Notice: Under 35 U.S.C. 154(b), the term of this patent shall be extended for 0 days.

(21) Appl. No.: 09/427,045

(22) Filed: Oct. 20, 1999

Related U.S. Application Data

(63) Continuation-in-part of application No. 09/138,042, filed on Aug. 19, 1998, now Pat. No. 6,047,798.

(51) Int. Cl.[7] ..... A45C 7/00; A45C 13/28

(52) U.S. Cl. ..... 190/103; 190/107; 190/39; 190/115; 280/37

(58) Field of Search ..... 190/18 A, 39, 190/103–105, 107, 115; 280/37; 16/113.1

(56) References Cited

U.S. PATENT DOCUMENTS

| | | | | |
|---|---|---|---|---|
| 764,144 | * | 7/1904 | McGowan | 190/105 |
| 1,573,721 | * | 2/1926 | Loeffler | 190/107 |
| 2,718,943 | * | 9/1955 | Braverman | 190/107 |
| 3,701,541 | * | 10/1972 | Tarducci et al. | 280/37 |
| 4,733,759 | * | 3/1988 | Shih-Chen | 190/103 X |
| 4,953,673 | * | 9/1990 | Ambasz | 190/103 |
| 5,251,731 | * | 10/1993 | Cassese et al. | 190/103 X |
| 5,476,184 | * | 12/1995 | Hill | 190/107 X |
| 5,664,652 | | 9/1997 | Shamah | 190/18 A |
| 5,819,891 | * | 10/1998 | Wang et al. | 190/105 X |

FOREIGN PATENT DOCUMENTS

| | | | | |
|---|---|---|---|---|
| 2632262 | * | 12/1989 | (FR) | 190/18 A |
| 19744 | * | of 1913 | (GB) | 190/105 |

* cited by examiner

*Primary Examiner*—Sue A. Weaver
(74) *Attorney, Agent, or Firm*—Charles E. Baxley

(57) ABSTRACT

A foldable suitcase has an upper shell and a retractable support secured to the suitcase for supporting the suitcase at a working position and a folded position. The support is pivotally secured to the suitcase for allowing the support to be folded between an upright position and a lay down position and to be folded toward the suitcase to a compact folding structure. A handle may be fixed to the upper shell or may be extended outward of the upper shell for carrying the suitcase. The support may be folded relative to the suitcase by the actuation of the handle.

13 Claims, 12 Drawing Sheets

FOLDABLE SUITCASE HAVING FOLDABLE HANDLE DEVICE

The present invention is a continuation-in-part of U.S. patent application Ser. No. 09/138,042, filed Aug. 19, 1989, U.S. Pat. No. 6,047,798.

BACKGROUND OF THE INVENTION

1. Field of the Invention

The present invention relates to a luggage article or a suitcase, and more particularly to a luggage article or a suitcase having a retractable and/or foldable handle device.

2. Description of the Prior Art

Typical foldable bags or suitcases or luggage articles comprise a middle portion that may be folded to a compact size for storing purposes, and a handle device provided for carrying the foldable luggage article. One of the typical foldable luggage articles is disclosed in U.S. Pat. No. 5,664,652 to Shamah and comprises a vertically expandable luggage article, and a vertically expandable handle device having at least three vertically stacked supports or tubular members secured to the luggage article. Only a rigid plate is secured to the upper portion of the top shell. When the intermediate and foldable shells of the luggage article are opened, only the right plate may be provided for supporting the top shell and the intermediate foldable shells are expanded to the working position, such that the luggage article may not be stably supported in place when the luggage article is expanded.

The present invention has arisen to mitigate and/or obviate the afore-described disadvantages of the conventional foldable bags or luggage articles.

SUMMARY OF THE INVENTION

The primary objective of the present invention is to provide a foldable suitcase having a retractable support for stably supporting the suitcase at the expanded position.

In accordance with one aspect of the invention, there is provided a suitcase comprising an expandable suitcase body expandable to a working position and foldable to a folded position, and a retractable support secured to the suitcase body for supporting the suitcase body at the working position and at the folded position. The support is pivotally secured to the base of the suitcase body for allowing the support to be folded toward the base of the suitcase body.

The suitcase body includes an upper shell having an upper portion and a lower portion, and includes a foldable middle portion provided between the base and the upper shell for forming a foldable structure to the suitcase body, the retractable support includes a pair of posts having a lower portion pivotally secured to the base of the suitcase body, a pair of tubes slidably received in the posts respectively and having an upper portion secured to the upper portion of the upper shell of the suitcase body. A bar is further secured to the lower portion of the upper shell of the suitcase body and includes a pair of orifices for slidably receiving the posts respectively.

The lower portions of the posts are pivotally coupled to the base of the suitcase body at a pin each for allowing the posts to be rotated relative to the base between an upright position and a lay down position, and means for securing the posts to the base at the upright position. The posts each includes a frame secured to the lower portion thereof and pivotally secured to the base at the pin, the frames each includes an aperture formed therein, the base includes at least one spring-biased projection engaged with the aperture of a first of the frames for securing the posts to the base at the upright position. The first frame includes a recess formed therein for engaging with the spring-biased projection and for securing the posts to the base at the lay down position.

The posts each includes an oblong hole formed in the lower portion thereof, a pair of knobs each having a lateral pole slidably engaged in the oblong holes and each having a stick slidably engaged in the aperture for disengaging the spring-biased projection from the aperture and for allowing the posts to be rotated relative to the base about the pin. A wheel device is further secured to the base of the suitcase body.

A handle device is further attached to the upper shell for carrying the suitcase and includes a pair of pipes slidably received in the tubes respectively and moved relative to the tubes between an extended position and a retracted position, and includes a hand grip provided between the pipes, and means for selectively securing the pipes at the extended position and the retracted position relative to the tubes.

The the foldable middle portion of the suitcase body includes at least one peripheral zipper device, the bar and the posts are secured in the suitcase body for preventing the posts from blocking the peripheral zipper device. A bracket is secured to the upper portion of the upper shell and includes the tubes extended therefrom and slidably engaged in the posts respectively.

A securing means is further provided for securing the posts to the bar and includes at least one hole formed in a first of the posts, a spring-biased projection disposed in the bar and engaged with the hole of the first post for securing the first post to the bar. The bar includes at least one block secured therein for receiving the spring-biased projection.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
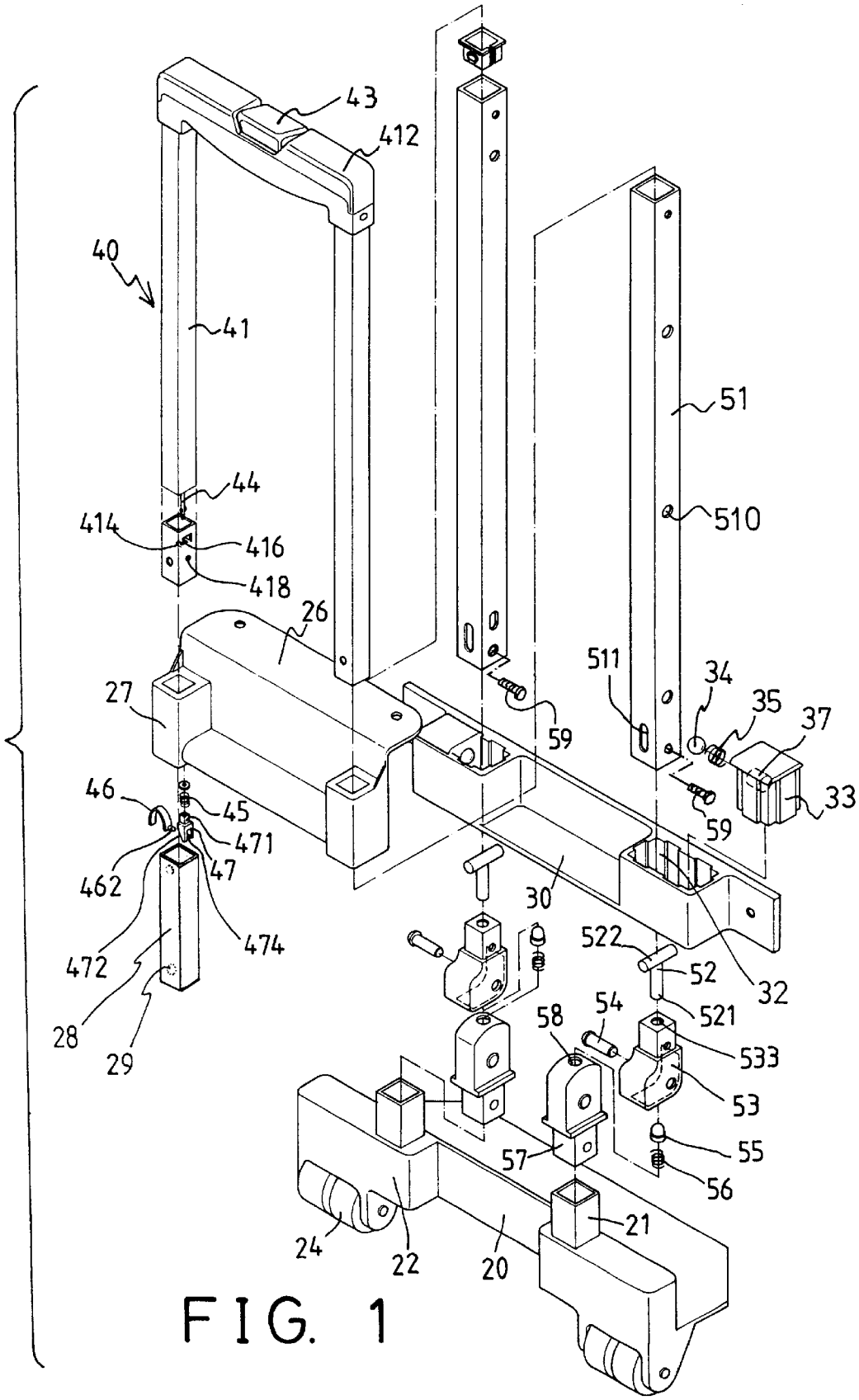
FIG. 1 is an exploded view of an expandable handle device for a foldable suitcase in accordance with the present invention.
Figure 2:
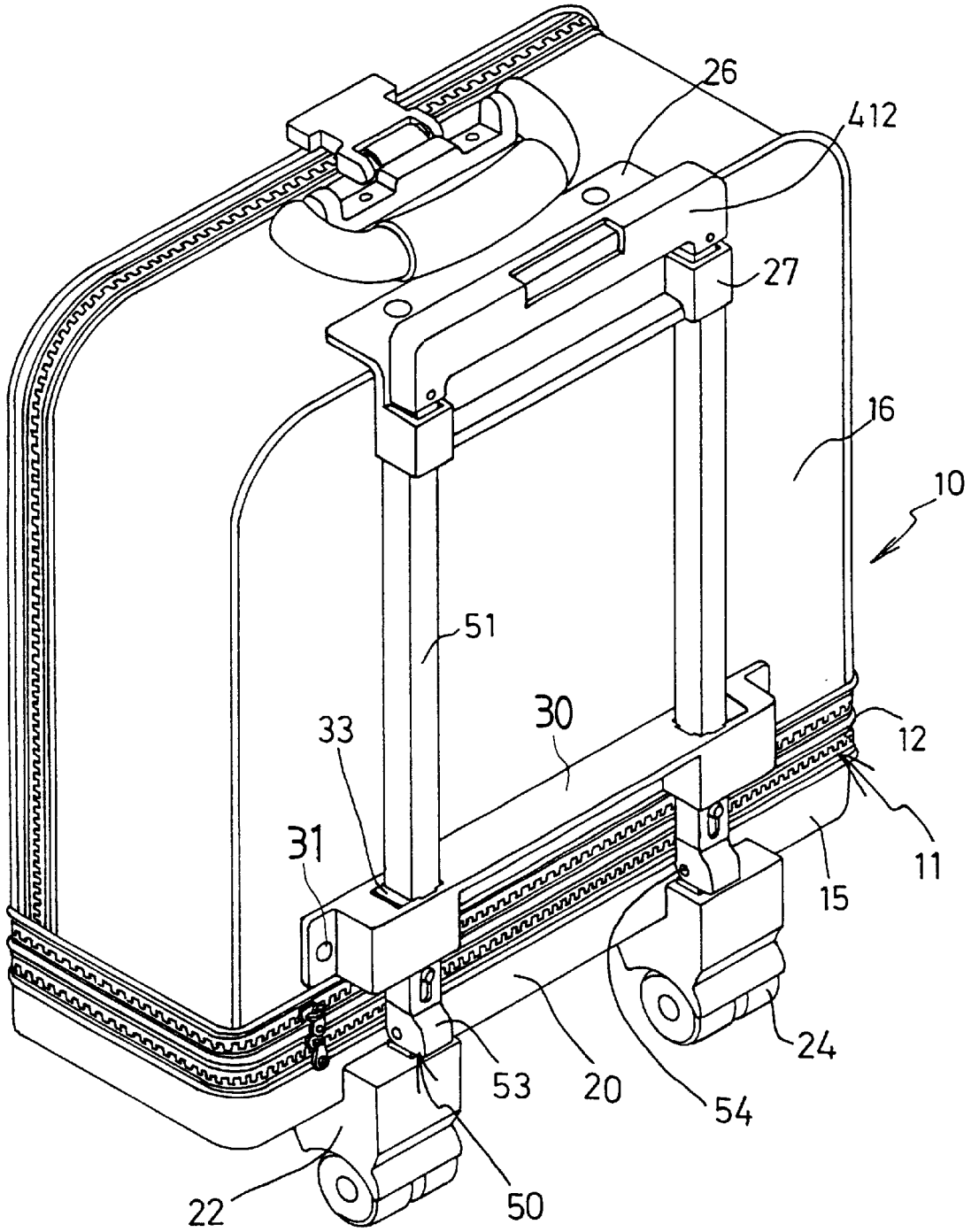
FIG. 2 is a rear perspective view of the suitcase.
Figure 3:
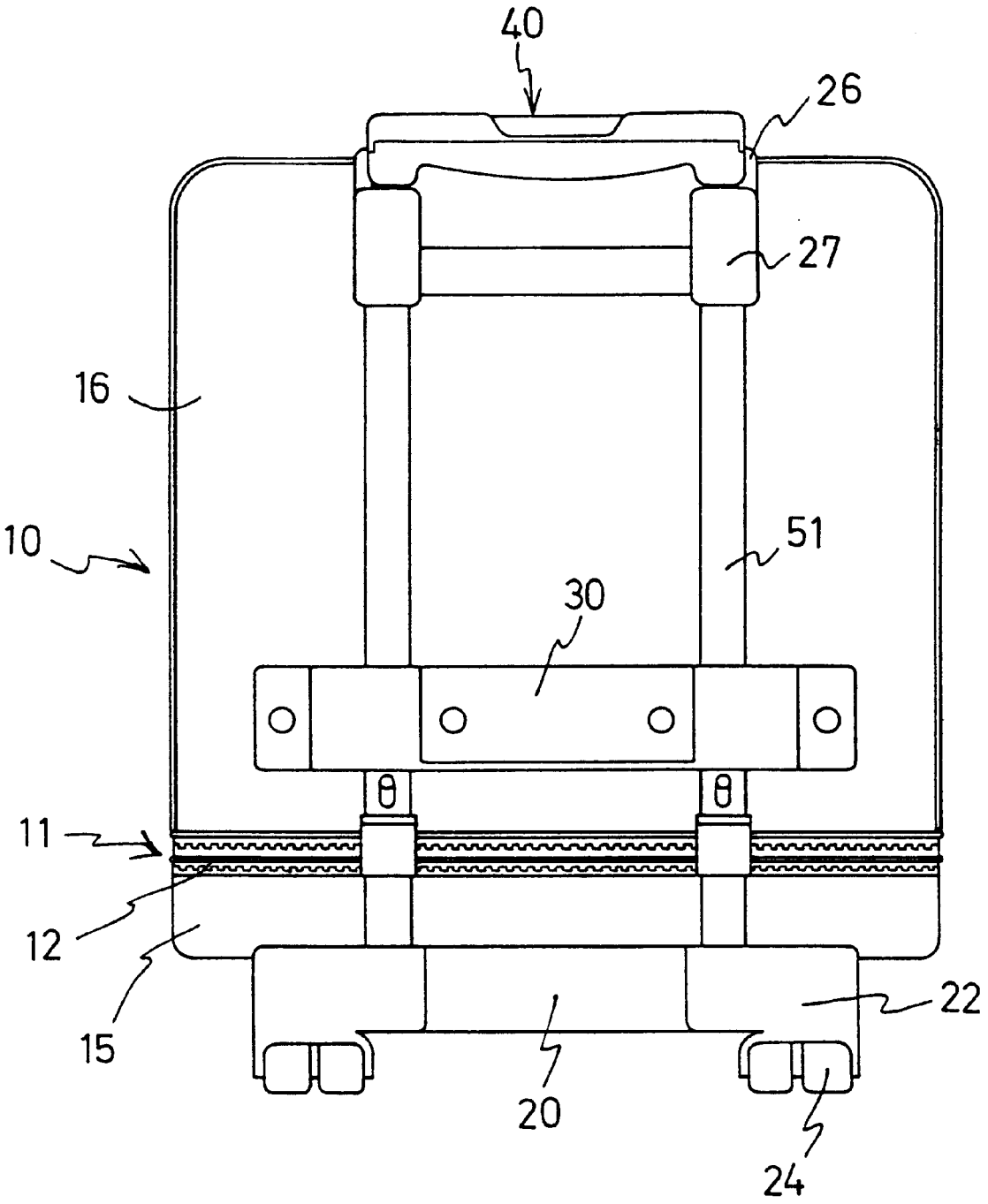
FIG. 3 is a rear view of the suitcase.
Figure 4:
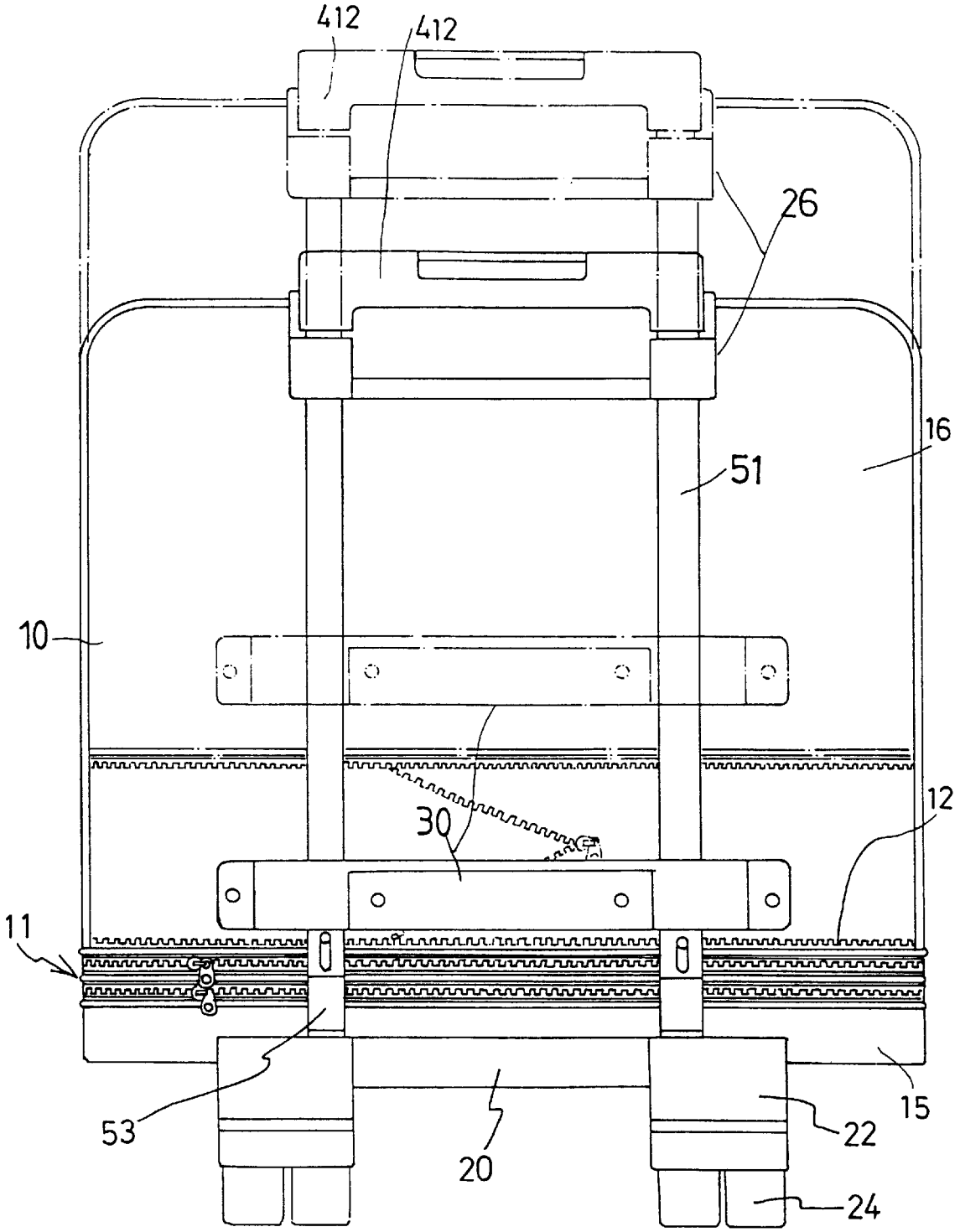
FIGS. 4, 5, 6 are rear views illustrating the operation of the foldable suitcase and the expandable handle device.
Figure 5:
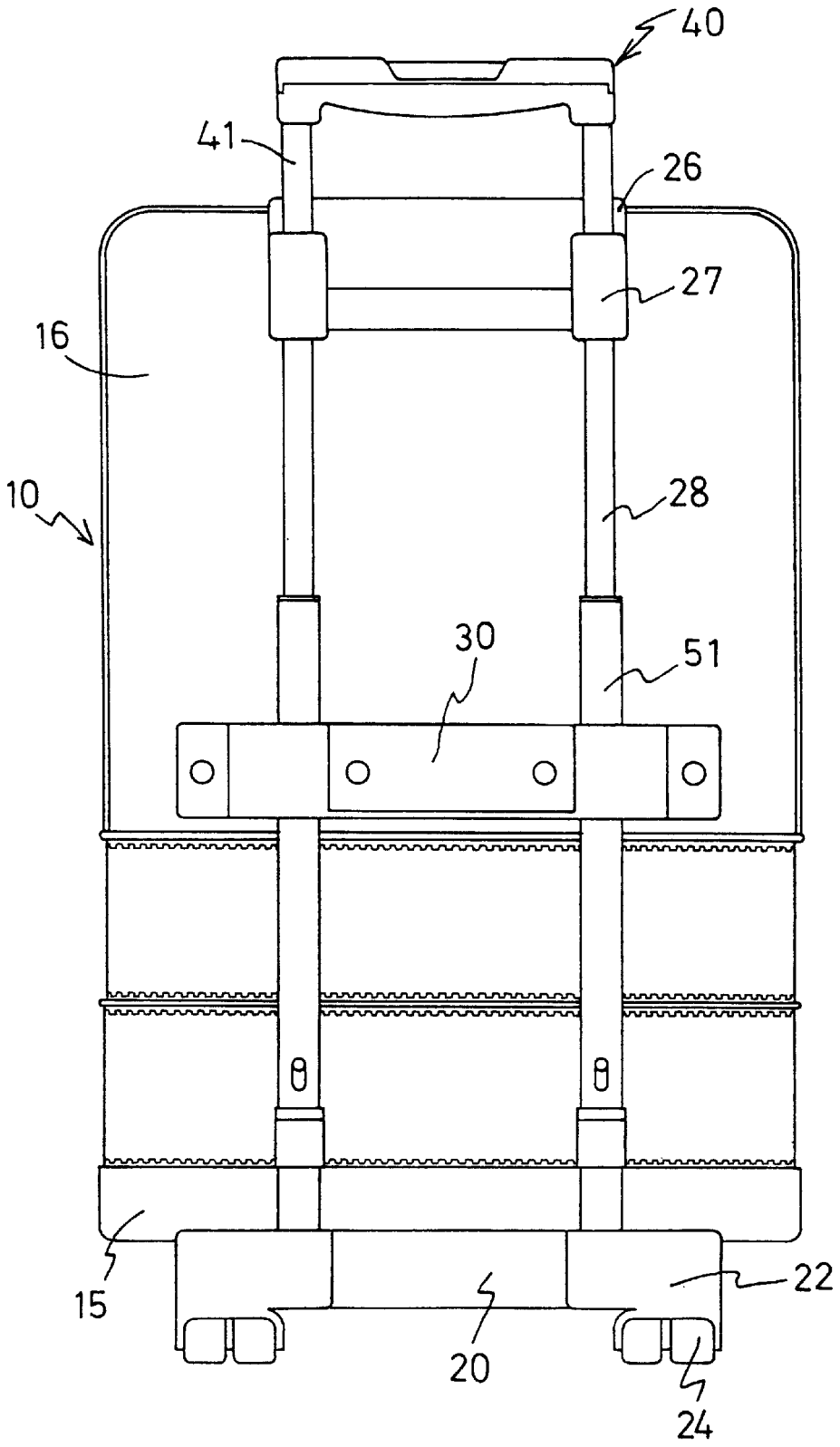

Referring to the drawings, and initially to FIGS. 2–6, a suitcase in accordance with the present invention comprises a suitcase body 10 including a foldable middle portion 11 formed between the lower shell 15 and the upper shell 16 of the suitcase body 10. One or more peripheral or helical zipper devices 12 are provided in the foldable middle portion 11 for allowing the middle portion 11 to be secured in the folded position as shown in FIGS. 2 and 3 by the zipper device 12 and to be opened or expanded to the working position as shown in FIGS. 4 and 5. The foldable structure for the suitcase is typical and will not be described in further details. The present invention is to provide a retractable or extendible handle device (FIG. 1) that is attached to the foldable suitcase for allowing the suitcase to be supported in the expanded position by the handle device. A base 20 is secured to the lower shell 15 of the suitcase body 10 for supporting one or more wheels 24 by one or more wheel cases 22. A pair of posts 51 have a lower end foldably secured to the lower shell 15 of the suitcase body 10 or preferably secured to the studs 21 that are extended upward from the wheel cases 22. One or both of the posts 51 each includes one or more holes 510 formed therein.

Figure 7:
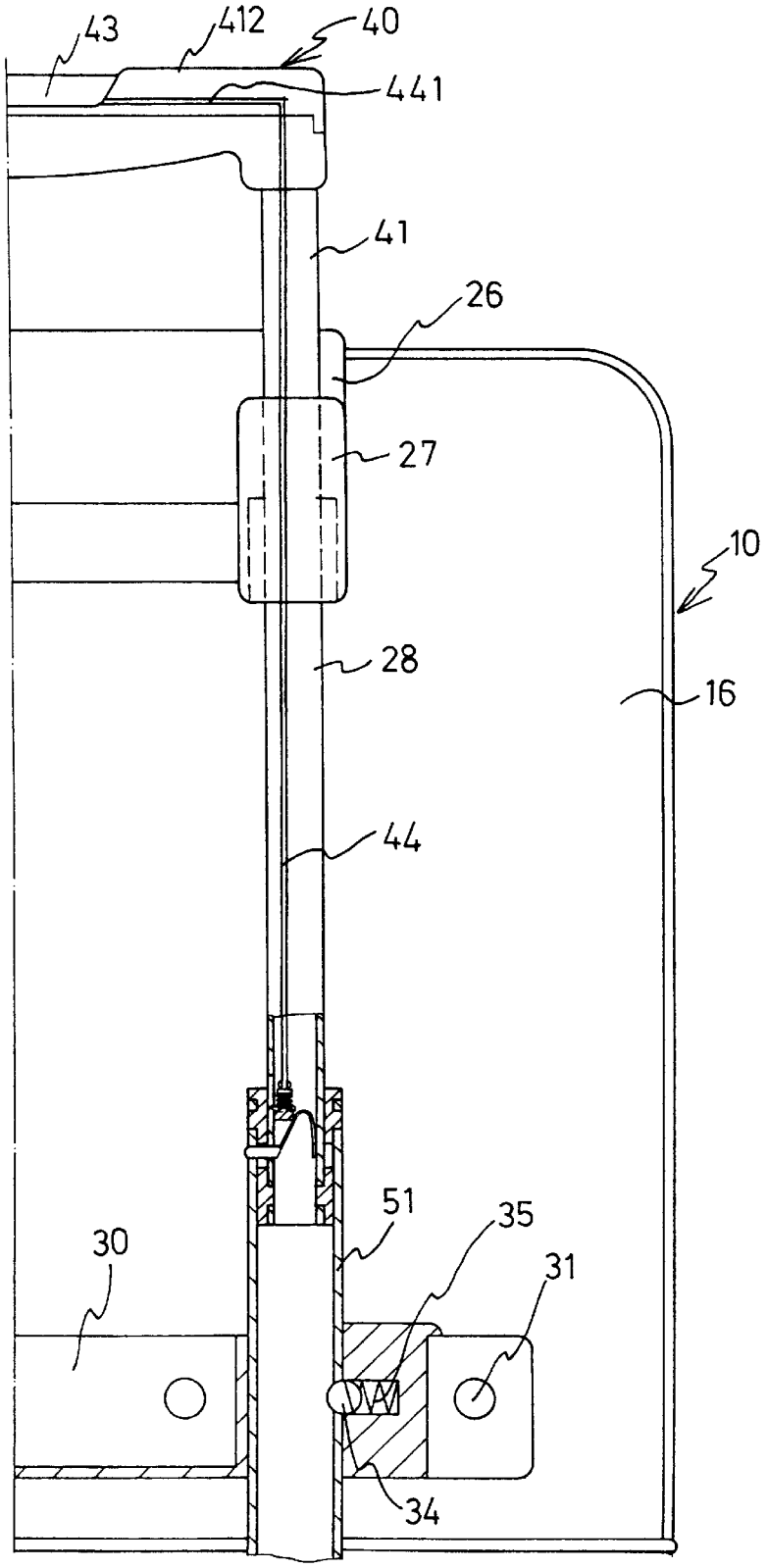
FIG. 7 is a partial cross sectional view illustrating the operation of the handle device for the foldable suitcase.

A bar 30 is secured to the lower portion of the upper shell 16 of the suitcase body 10 with fasteners 31 (FIGS. 2, 7), for example, and a bracket 26 is secured to the upper portion of the upper shell 16 of the suitcase body 10 with such as fasteners, such that the bar 30 and the bracket 26 are moved in concert with the upper shell 16 of the suitcase body 10. The bar 30 includes two orifices 32 formed therein for slidably receiving the posts 51 respectively; i.e., the posts 51 may be slided relative to the bar 30, or the bar 30 may be slided relative to the posts 51. The bracket 26 includes two sides 27 each having a tube 28 extended downward therefrom or secured thereto (FIGS. 1, 7) and slidably received in the respective posts 51. It is preferable that the sides 27 of the bracket 26 each includes a barrel formed therein or each has the tubes 28 directly extended therefrom, such that the tubes 28 may also be moved in concert with the bracket 30 and are slidably received in the respective posts 51. One or two or more blocks 33 are secured to the bar 30, and preferably secured in the orifices 32 of the bar 30 by such as fasteners or by welding processes. The blocks 33 each includes an apertures 37 laterally formed therein for receiving a spring-biased projection that includes a spring 35 and a ball 34 therein. The ball 34 is biased by the spring 35 to engage with either of the holes 510 of the posts 51 (FIG. 7) for securing and positioning the bar 30 and the upper shell 16 to the posts 51 and for securing the upper shell 16 of the suitcase body 10 relative to the base 20 and the posts 51 at any suitable or selected position, such as at the expanded working position or at the folded position.

Figure 6:
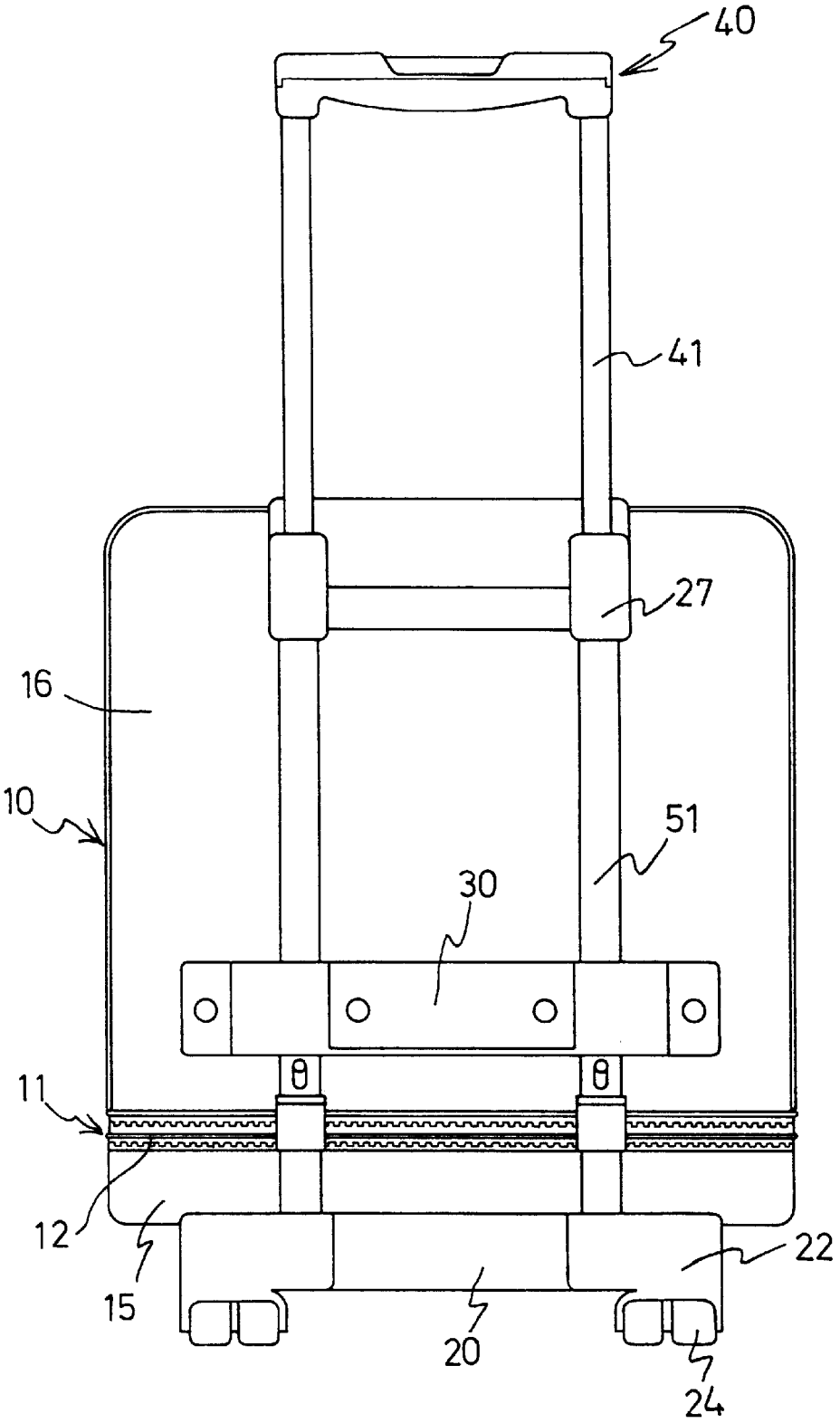

Two pipes 41 of a retractable handle device 40 are slidably received in the tubes 28 and/or the barrel-shaped sides 27 of the bracket 26 respectively and have an upper portion secured together by a handle 412. A hand grip 43 is slidably received in the handle 412 and movable up and down relative to the handle 412 or depressible inward of the handle 412. Two rods 44 are slidably received in the pipes 41 respectively and have an upper end secured to the hand grip 43 by a link 441 such that the rods 44 may be moved up and down by the hand grip 43. The pipes 41 each includes an ear 414 extended inward therefrom and having an opening 416 for slidably receiving an upward extension 471 of an actuator 47. The extensions 471 are secured to bottom of the respective rods 44 such that the actuators 47 may be moved by the hand grip 43. A spring-biased latch 46 is received in each of the pipes 41 and includes a tongue 462 extended through a hole 418 of the respective pipe 41 for engaging with either of a number of orifices 29 of the respective tube 28 and for securing the pipes 41 of the handle device 40 to the tubes 28 at any suitable or selected positions. The actuators 47 each includes a notch 474 for slidably receiving the tongue 462 and each includes a tapered surface 472 for engaging with the latch 46 and for disengaging the tongue 462 of the latch 46 from the orifice 29 of the tube 28 and for allowing the pipes 41 to be slided relative to the respective tubes 28 and thus for allowing the handle device 40 to be extended from the bracket 26 to the open or working position (FIG. 6). A spring 45 is engaged between the ear 414 of the pipe 41 and the actuator 47 for biasing the actuator 47 away from the latch 46.

One or more intermediate duct may further be provided and slidably engaged between the respective tubes 28 and pipes 41 for further increasing the extendible length of the handle device 40. It is to be noted that the pipes 41 of the handle device 40 are slidably secured in the tubes 28 and may be moved relative to the tubes 28. The handle device 40 may also be solidly secured to the bracket 26 or directly to the upper shell 16. The operation of the handle device 40 will not affect the movement of the upper shell 16 and the bracket 26 relative to the posts 51. The sliding engagement of the pipes 41 in the posts 51 form a two-section telescopic tube or a retractable support for the foldable suitcase; i.e., the specially designed two-section retractable support is good enough to support the suitcase in the folded and the expanded positions (FIGS. 3–6). As best shown in FIG. 5, the bar 30 is substantially located in the middle portion of the expanded suitcase body 10 and is engaged on the posts 51 such that the expanded suitcase body 10 may be solidly secured to the posts 51 and the tubes 28. U.S. Pat. No. 5,664,652 to Shamah discloses and comprises a vertically expandable handle device having at least three vertically stacked supports or tubular members secured to the luggage article. The present invention includes a two-section handle device attached to a foldable suitcase for supporting the suitcase either when the suitcase is folded or expanded.

Figure 8:
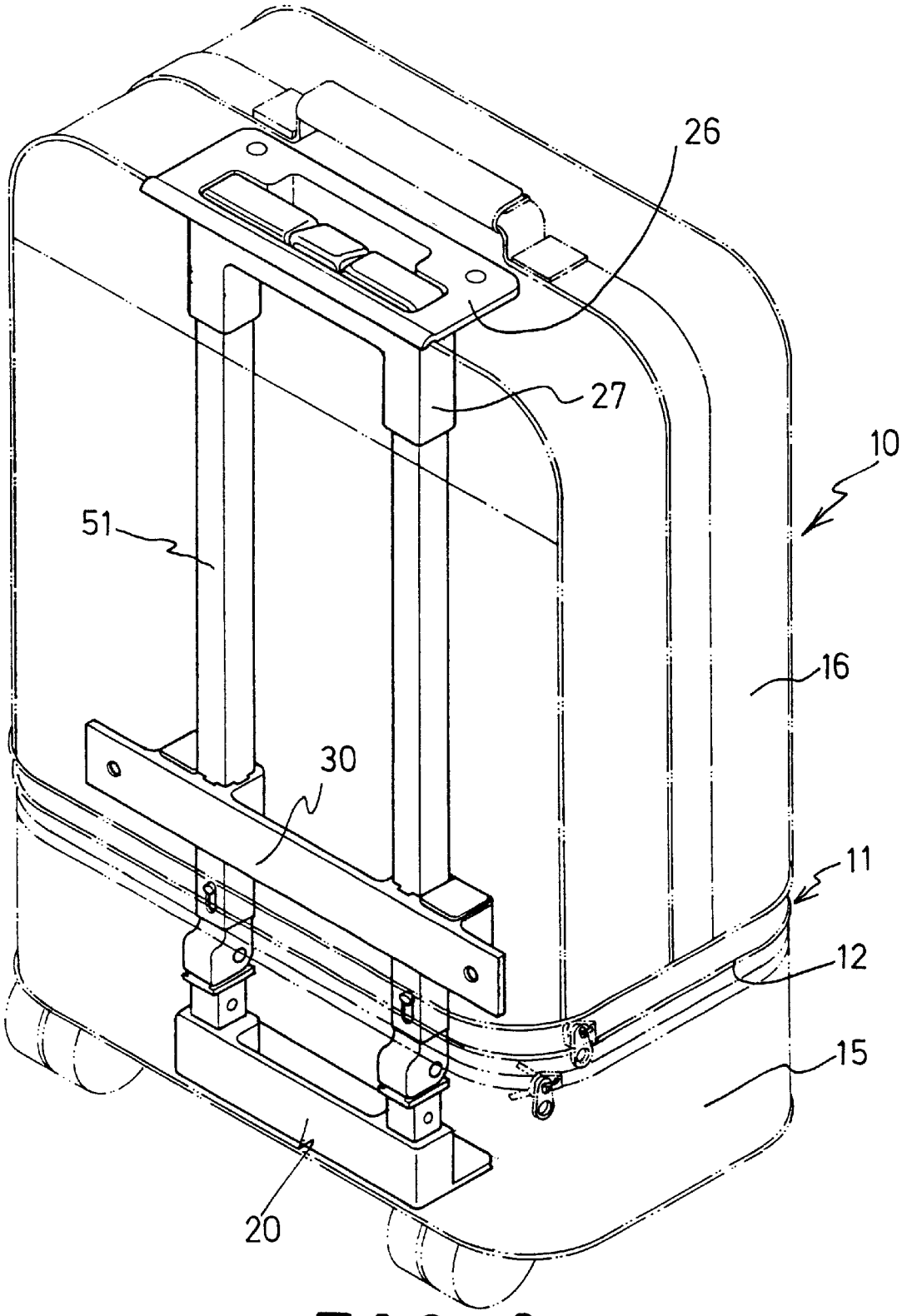
FIG. 8 is a rear perspective view illustrating the other application of the suitcase.

As shown in FIG. 8, the posts 51 and the bar 30 are preferably secured in the inner portion of the foldable suitcase 10, such that the zipper device 12 of the foldable middle portion 11 of the suitcase 10 may be exposed or will not be blocked by the posts 51, such that the zipper device 12 of the foldable middle portion 11 of the suitcase 10 may be easily operated by the users.

Figure 10:
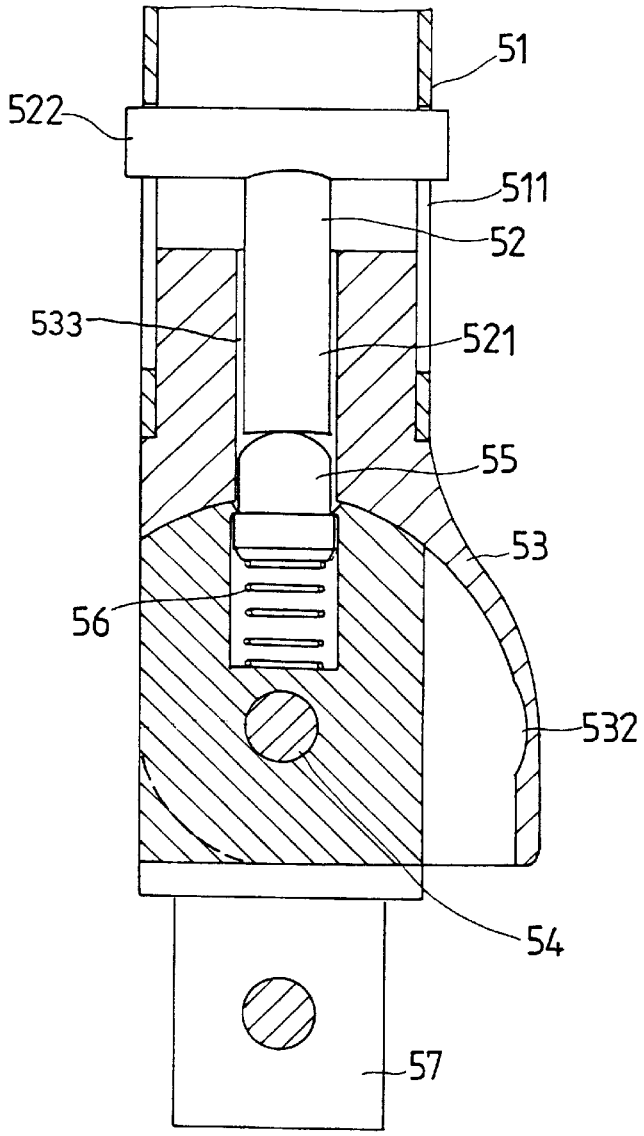
FIG. 10 is a partial cross sectional view taken along lines 10—10 of FIG. 9.
Figure 9:
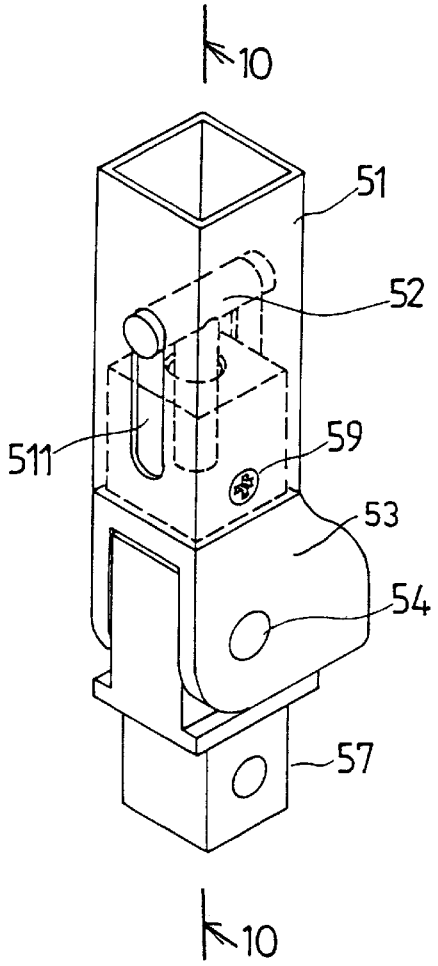
FIG. 9 is a partial perspective view of the handle device.
Figure 11:
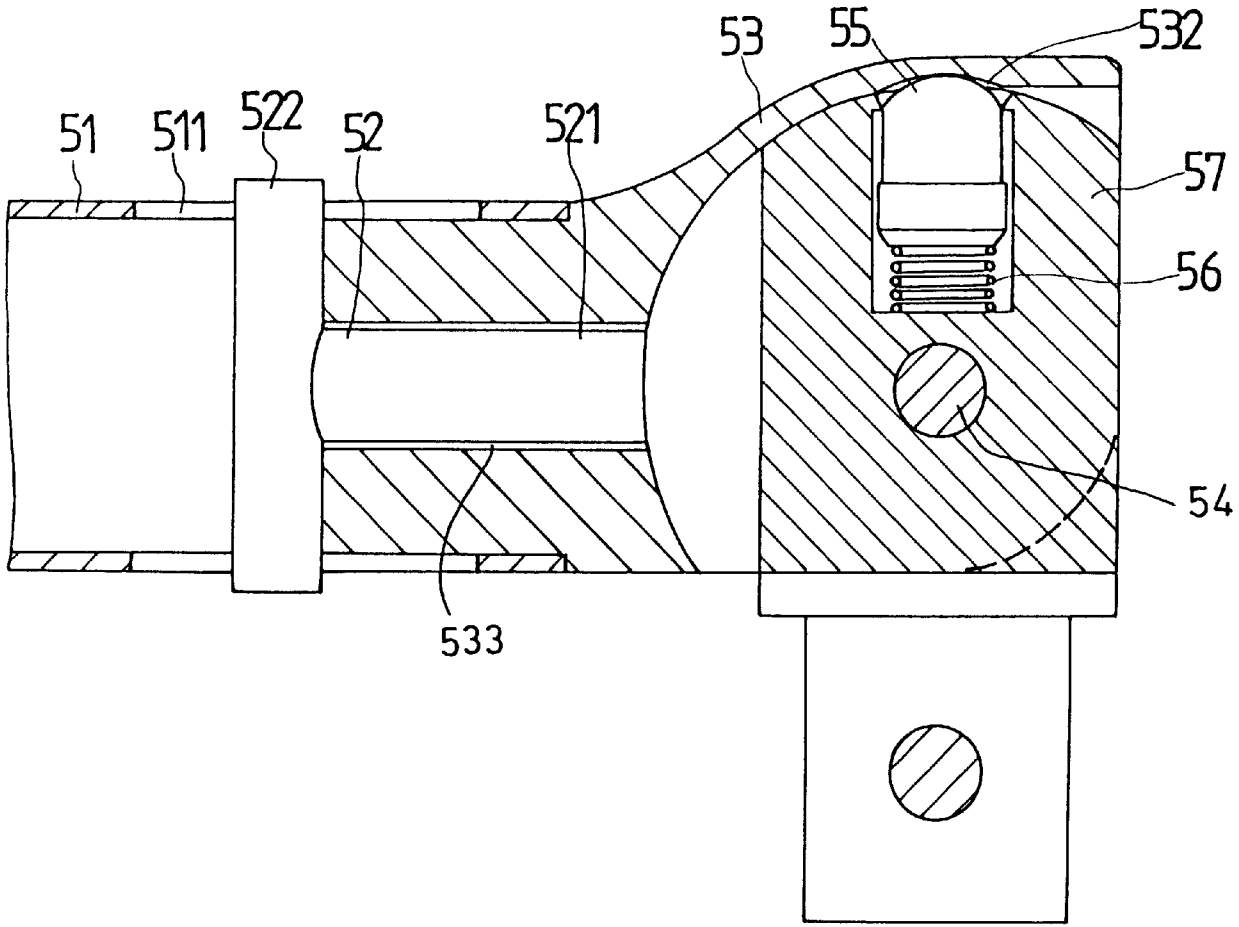
FIG. 11 is a cross sectional view similar to FIG. 10, illustrating the operation of the foldable mechanism for the handle device.

Referring next to FIGS. 9–11 and again to FIGS. 1 and 2, the posts 51 may be coupled to the base 20 with a foldable mechanism 50 which includes two frames 53 secured to the bottoms of the posts 51 by fasteners 59, for example. The posts 51 each includes one or two oblong holes 511 formed in the bottom portion thereof. Two couplers 57 are extended from the base 20 or secured to the studs 21 of the base 20 with fasteners, and each includes a cavity 58 formed in the upper portion for receiving a spring-biased projection that includes a spring 56 and a catch 55. The frame 53 includes an aperture 533 formed in the upper portion and a recess 532 formed in the lower potion (FIGS. 10, 11) and is pivotally secured to the respective coupler 57 at a pin 54. The catch 55 is biased to engage with the aperture 533 (FIG. 10 and FIGS. 3–6) for securing the post 51 at the upright position relative to the base 20, or to engage with the recess 532 (FIG. 11) for securing the post 51 at the lay down position relative to the base 20. A knob 52 includes a lateral pole 522 slidably engaged in the oblong holes 511 of the posts 51, and includes a stick 521 slidably received in the aperture 533 of the frame 53 for disengaging the catch 55 from the aperture 533 of the frame 53 when the pole 522 of the knob 52 is depressed downward against the spring 56. The pipes 41 may be forced downward to engage with and to depress the knob 52 against the spring-biased projection 55 for disengaging the projection 55 from the frame 53 and for allowing the frame 53 to be rotated relative to the coupler 57. One or both ends of the pole 522 of the knob 52 may be extended outward of the posts 51 for allowing the knob 52 to be depressed against the spring 56 by the user without the handle device 40.

Figure 12:
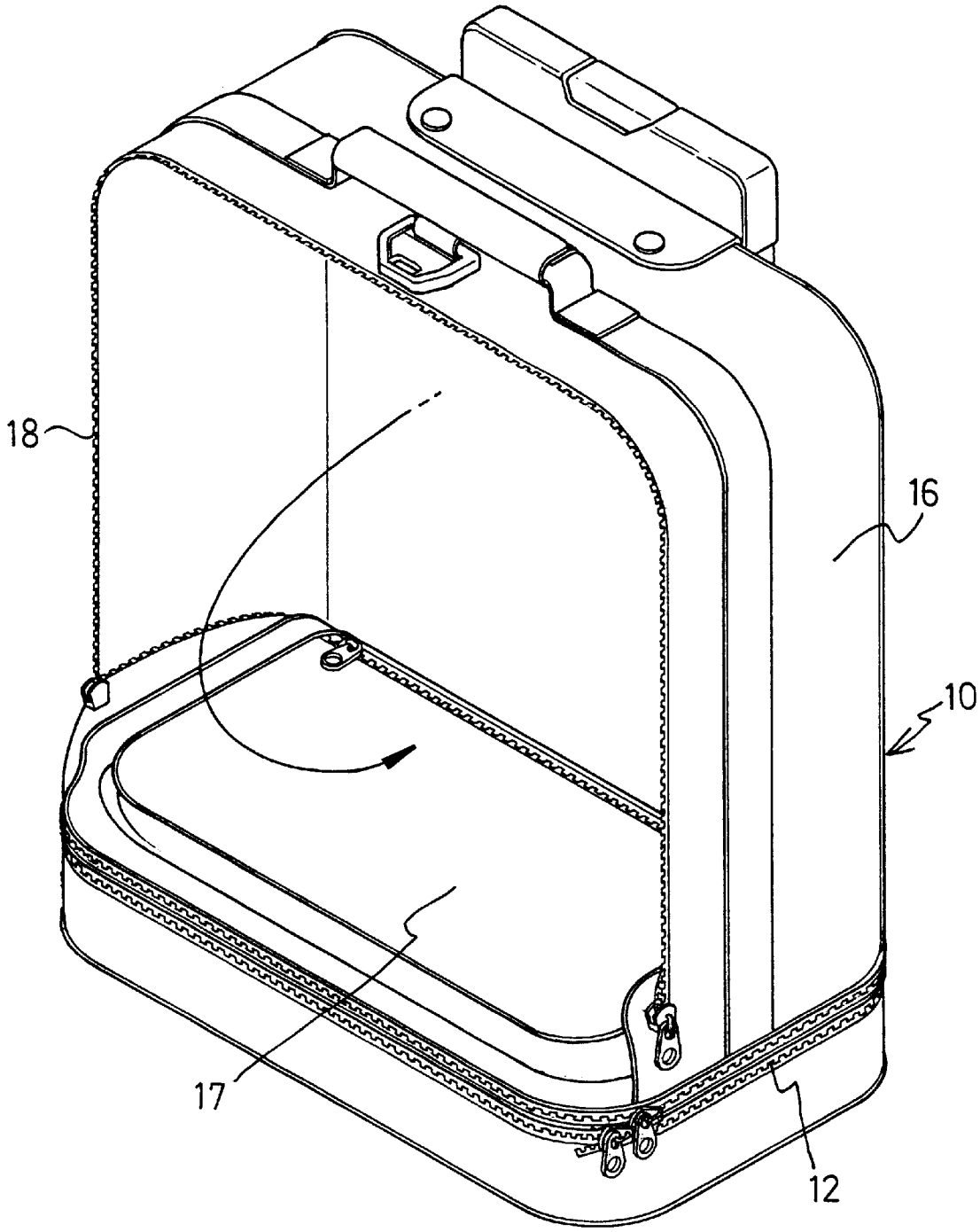
FIGS. 12, 13, 14 are perspective views illustrating the folding operation of the foldable suitcase and the handle device.
Figure 13:
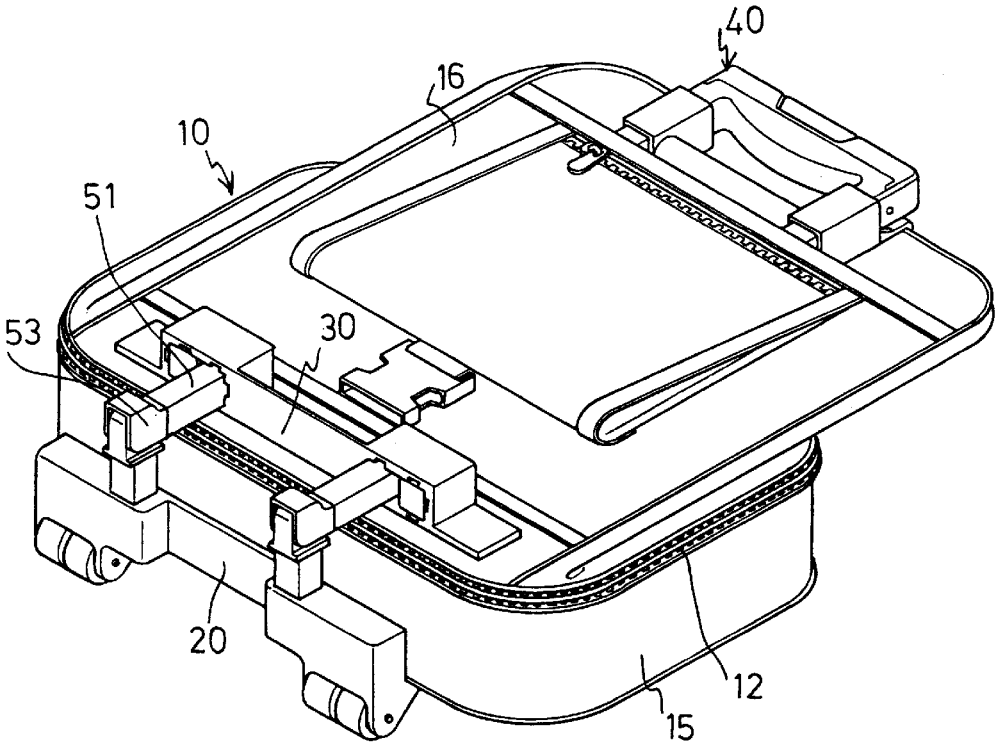
Figure 14:
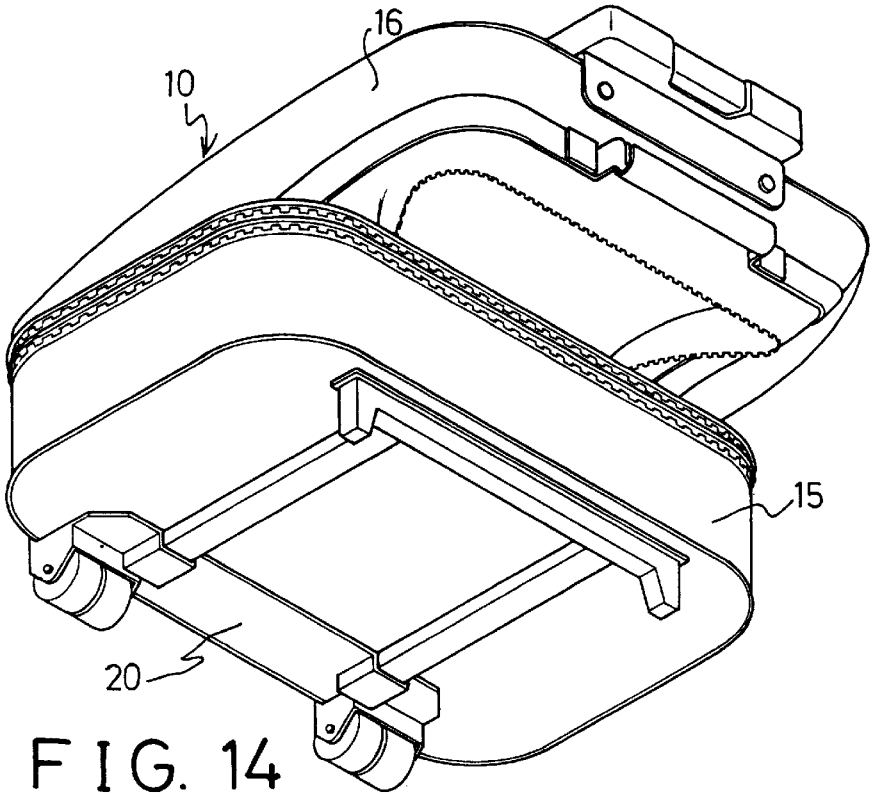

The posts 51 may be rotated relative to the couplers 57 about the pin 54 for allowing the suitcase 10 to be folded to a compact configuration. For example, as shown in FIGS. 12–14, the suitcase 10 includes a foldable structure for allowing the suitcase 10 to be folded to the compact folding structure. For example, the upper shell 16 of the suitcase 10 includes a cover 17 secured to the front portion of the upper shell 16 with a zipper device 18 for allowing the cover 17 to be folded inward of the upper shell 16 (FIG. 12) before the upper shell 16 may be folded to the compact structure (FIGS. 13, 14).

Accordingly, the suitcase in accordance with the present invention includes a retractable support that is retractable when the suitcase is folded, and that is extendible when the suitcase is opened, and that may be provided for stably supporting the suitcase when the suitcase is expanded to the open position. The retractable support or the retractable handle device and the suitcase may all be folded to a compact configuration when the handle device is folded relative to the base of the suitcase.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A suitcase comprising:

a) an expandable suitcase body expandable to a working position and foldable to a folded position, said suitcase body including a base, and including an upper shell having an upper portion and a lower portion, and including a foldable middle portion provided between said base and said upper shell for forming a foldable structure to said suitcase body, b) a retractable support secured to said suitcase body for supporting said suitcase body at said working position and at said folded position respectively, said retractable support including a pair of posts having a lower portion pivotally secured to said base of said suitcase body, a pair of tubes slidably received in said posts respectively and having an upper portion secured to said upper portion of said upper shell of said suitcase body, and c) a bar secured to said lower portion of said upper shell of said suitcase body and including a pair of orifices for slidably receiving said posts respectively and for slidably securing said upper shell to said posts.

2. The suitcase according to claim 1, wherein said lower portions of said posts are pivotally coupled to said base of said suitcase body at a pin each for allowing said posts to be rotated relative to said base between an upright position and a lay down position, and means for securing said posts to said base at said upright position.

3. The suitcase according to claim 2, wherein said posts each includes a frame secured to said lower portion thereof and pivotally secured to said base at said pin, said frames each includes an aperture formed therein, said base includes at least one spring-biased projection engaged with said aperture of a first of said frames for securing said posts to said base at said upright position.

4. The suitcase according to claim 3, wherein said first frame includes a recess formed therein for engaging with said at least one spring-biased projection and for securing said posts to said base at said lay down position.

5. The suitcase according to claim 1 further comprising a wheel device secured to said base of said suitcase body.

6. The suitcase according to claim 1 further comprising a handle device attached to said upper shell for carrying said suitcase.

7. The suitcase according to claim 1, wherein said foldable middle portion of said suitcase body includes at least one peripheral zipper device, said bar and said posts are secured in said suitcase body for preventing said posts from blocking said at least one peripheral zipper device.

8. The suitcase according to claim 1 further comprising a bracket secured to said upper portion of said upper shell and including said tubes extended therefrom and slidably engaged in said posts respectively.

9. The suitcase according to claim 1 further comprising means for securing said posts to said bar.

10. The suitcase according to claim 9, wherein said securing means includes at least one hole formed in a first of said posts, a spring-biased projection disposed in said bar and engaged with said at least one hole of said first post for securing said first post to said bar.

11. The suitcase according to claim 10, wherein said bar includes at least one block secured therein for receiving said spring-biased projection.

12. A suitcase comprising:

a) an expandable suitcase body expandable to a working position and foldable to a folded position, said suitcase body including a base and including an upper shell having an upper portion and a lower portion and including a foldable middle portion provided between said base and said upper shell for forming a foldable structure to said suitcase body, b) a retractable support secured to said suitcase body for supporting said suitcase body at said working position and at said folded position respectively, said retractable support including;

i) a pair of posts having a lower portion, said posts each including a frame secured to said lower portion thereof and pivotally secured to said base with a pin for allowing said posts to be rotated relative to said base between an upright position and a lay down position, said frames each including an aperture formed therein, said base including at least one spring-biased projection engaged with said aperture of a first of said frames for securing said posts to said base at said upright position, and ii) a pair of tubes slidably received in said posts respectively and having an upper portion secured to said upper portion of said upper shell of said suitcase body, and c) means for securing said posts to said base at said upright position, wherein said posts each includes an oblong hole formed in said lower portion thereof, a pair of knobs each having a lateral pole slidably engaged in said oblong holes and each having a stick slidably engaged in said aperture for disengaging said spring-biased projection from said aperture and for allowing said posts to be rotated relative to said base about said pin.

13. A suitcase comprising:

a) an expandable suitcase body expandable to a working position and foldable to a folded position, said suitcase body including a base and including an upper shell having an upper portion and a lower portion and including a foldable middle portion provided between said base and said upper shell for forming a foldable structure to said suitcase body, b) a retractable support secured to said suitcase body for supporting said suitcase body at said working position and at said folded position respectively, said retractable support including;

i) a pair of posts having a lower portion pivotally secured to said base of said suitcase body, ii) a pair of tubes slidably received in said posts respectively and having an upper portion secured to said upper portion of said upper shell of said suitcase body, and c) a handle device attached to said upper shell for carrying said suitcase, wherein said handle device includes a pair of pipes slidably received in said tubes respectively and moved relative to said tubes between an extended position and a retracted position, and includes a hand grip provided between said pipes, and means for selectively securing said pipes at said extended position and said retracted position relative to said tubes.

* * * * *